US008466849B2

(12) United States Patent
Yoon et al.

(10) Patent No.: US 8,466,849 B2
(45) Date of Patent: Jun. 18, 2013

(54) ANTENNA DEVICE FOR PORTABLE TERMINAL

(75) Inventors: Jun Yoon, Gumi-si (KR); Yeong-Moo Ryu, Daegu (KR); Kwon-Sik Min, Gumi-si (KR)

(73) Assignee: Samsung Electronics Co., Ltd (KR)

( * ) Notice: Subject to any disclaimer, the term of this patent is extended or adjusted under 35 U.S.C. 154(b) by 746 days.

(21) Appl. No.: 12/248,433

(22) Filed: Oct. 9, 2008

(65) Prior Publication Data

US 2009/0096708 A1 Apr. 16, 2009

(30) Foreign Application Priority Data

Oct. 12, 2007 (KR) ..... 10-2007-0103087

(51) Int. Cl.
*H01Q 3/24* (2006.01)

(52) U.S. Cl.
USPC ..... 343/876; 343/900

(58) Field of Classification Search
USPC ..... 343/702, 876; 455/572
See application file for complete search history.

(56) References Cited

U.S. PATENT DOCUMENTS

| | | | | |
|---|---|---|---|---|
| 4,958,382 | A * | 9/1990 | Imanishi | 455/277.1 |
| 6,111,345 | A * | 8/2000 | Shibata et al. | 313/141 |
| 6,753,827 | B2 * | 6/2004 | Oshiyama et al. | 343/876 |
| 7,545,332 | B2 * | 6/2009 | Kim et al. | 343/702 |
| 2003/0048227 | A1 * | 3/2003 | Nakamura | 343/702 |

* cited by examiner

*Primary Examiner* — Jacob Y Choi
*Assistant Examiner* — Kyana R McCain
(74) *Attorney, Agent, or Firm* — The Farrell Law Firm, P.C.

(57) ABSTRACT

An antenna device for a portable terminal, in which a first radiator is installed within the portable terminal, a second radiator is elongated lengthwise and installed to be retractable into and extendable from the portable terminal, and a switch portion has at least one plate spring and connects a communication circuit portion of the portable terminal selectively to the first radiator or the second radiator. When the second radiator is retracted into the portable terminal, the communication circuit portion is connected to the first radiator through the at least one plate spring, and when the second radiator is extended from the portable terminal, the communication circuit portion is connected to the second radiator through the at least one plate spring.

12 Claims, 5 Drawing Sheets

ANTENNA DEVICE FOR PORTABLE TERMINAL

PRIORITY

This application claims priority under 35 U.S.C. §119(a) to a Korean Patent Application filed in the Korean Intellectual Property Office on Oct. 12, 2007 and assigned Serial No. 2007-103087, the disclosure of which is hereby incorporated by reference.

BACKGROUND OF THE INVENTION

1. Field of the Invention

The present invention generally relates to a portable terminal. More particularly, the present invention relates to a portable terminal having an antenna device that can offer an appropriate transmission/reception performance according to a propagation environment.

2. Description of the Related Art

Typically, a portable terminal is a device that provides a wireless communication function between users or between a user and a service provider through a mobile communication Base Station (BS). A variety of contents including voice calls, short message transmission, mobile banking, Television (TV) broadcasting, on-line gaming, Video On Demand (VOD), etc., are provided to users through their portable terminals.

According to their outward appearances, portable terminals are categorized into a bar type, a flip type, and a folder type. The bar-type terminal has a communication circuit and an input/output device, such as a transmitter and a receiver, in a single housing. The flip-type terminal further includes a flip cover secured onto a bar-type terminal. The folder-type terminal is characterized by a pair of housings engaged with each other rotatably and input/output devices distributed to the housings. Along with the recent emergence of a sliding-type terminal, efforts have been made to satisfy diverse tastes of users, increasing portability and user-friendliness, with the sliding-type terminal together with the folder-type terminal.

Also, mobile communication services are diversifying, and how include on-line gaming, transmission of moving picture files, mobile banking, VOD, Digital Multimedia Broadcasting (DMB), etc., through portable terminals. The diversification of mobile communication services is attributed to the proliferation of portable terminals and various user demands that are a driving force behind commercialized provision of various contents through portable terminals.

Various types of antenna devices are installed in portable terminals to provide various services. Since all areas are not under a good and uniform propagation environment in real implementation, the antenna devices are typically designed in such a manner that users select appropriate antennas according to their propagation environments. That is, even though a user does not select a particular antenna device in a good propagation environment, his terminal is capable of transmission and reception. In a bad propagation environment, the user may additionally install an antenna module to the portable terminal or pull out an external antenna of the portable terminal.

A problem encountered with installing antenna devices is that transmission/reception signals interfere with each other between different antenna devices. For example, a terminal with an internal antenna and a retractable external antenna can ensure a sufficient transmission/reception performance with the internal antenna alone in a good propagation environment, whereas the external antenna is extended in a bad propagation environment. With the external antenna inserted, a noise signal is introduced to the external antenna, resulting in degradation of signal quality. That is, when only the internal antenna operates, a noise signal is introduced to the external antenna and thus the internal antenna does not perform optimally. Similarly, when the external antenna is extended, a noise signal introduced to the internal antenna prevents performance unique to the external antenna.

SUMMARY OF THE INVENTION

The present invention substantially addresses at least the above-described problems and/or disadvantages and provides at least the advantages described below. Accordingly, an aspect of the present invention is to provide an antenna device in a portable terminal, for operating an internal antenna or an external antenna independently according to a propagation environment or user selection and preventing interference between the internal antenna and the external antenna.

Another aspect of the present invention provides an antenna device in a portable terminal, for preventing interference between the radiators and thus ensuring a good transmission/reception signal quality, despite installation of different radiators in the portable terminal.

In accordance with an aspect of the present invention, there is provided an antenna device for a portable terminal, in which a first radiator is installed within the portable terminal, a second radiator is elongated lengthwise and installed to be retractable into and extendable from the portable terminal, and a switch portion has at least one plate spring and connects a communication circuit portion of the portable terminal selectively to the first radiator or the second radiator. When the second radiator is retracted into the portable terminal, the communication circuit portion is connected to the first radiator through the at least one plate spring, and when the second radiator is extended from the portable terminal, the communication circuit portion is connected to the second radiator through the at least one plate spring.

The second radiator can include a sliding terminal for sliding in the portable terminal, and a rod antenna extended lengthwise and rotatably combined with the sliding terminal.

Also, the second radiator can be a multi-antenna having a pair of tubes extended lengthwise, where one tube is retractable into and extendable from the other tube. It is preferred that an outer circumferential surface of the second radiator is coated with an insulation material.

The switch portion includes an antenna carrier having an outer circumferential surface attached with the first radiator and a groove for mounting the second radiator, a first plate spring having one end connected to the first radiator and fixed to the antenna carrier and one other end rendered movable, a second plate spring having one end connected to the second radiator and fixed to the antenna carrier and one other end rendered movable, and a connector connected to the communication circuit portion and installed in the antenna carrier. When the second radiator is retracted into the portable terminal, the first and second plate springs are interfered by the outer circumferential surface of the second radiator, the other end of the first plate spring contacts the connector, and the second plate spring is disconnected from the connector, and when the second radiator is extended from the portable terminal, the first plate spring is removed from the connector by an elastic force of the first plate spring and simultaneously, the other end of the second plate spring contacts the connector by an elastic force of the second plate spring. The switch portion can further include first and second power supply terminals installed in the antenna carrier.

When the first and second power supply terminals are installed, the one end of the first plate spring is fixed to the first power supply terminal and the one end of the second plate spring is fixed to the second power supply terminal.

Meanwhile, the switch portion can be modified to include an antenna carrier having an outer circumferential surface attached with the first radiator and a groove for mounting the second radiator, a connector connected to the communication circuit portion and installed in the antenna carrier, a first power supply terminal installed in the antenna carrier and electrically connected to the first radiator, a second power supply terminal installed in the antenna carrier, for electrically connecting to the second radiator, when the second radiator is extended from the portable terminal, and a plate spring having one end fixed to the connector. If the single plate spring is installed in the switch portion, when the second radiator is retracted into the portable terminal, the plate spring is interfered by the outer circumferential surface of the second radiator and contacts the first power supply terminal, and when the second radiator is extended from the portable terminal, the plate spring contacts the second power supply terminal by an elastic force of the plate spring.

BRIEF DESCRIPTION OF THE DRAWINGS

The above and other aspects, features and advantages of the present invention will be more apparent from the following detailed description taken in conjunction with the accompanying drawings, in which.

Throughout the drawings, the same drawing reference numerals will be understood to refer to the same elements, features and structures.

DETAILED DESCRIPTION OF THE PREFERRED EMBODIMENTS

The matters defined in the description such as a detailed construction and elements are provided to assist in a comprehensive understanding of preferred embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
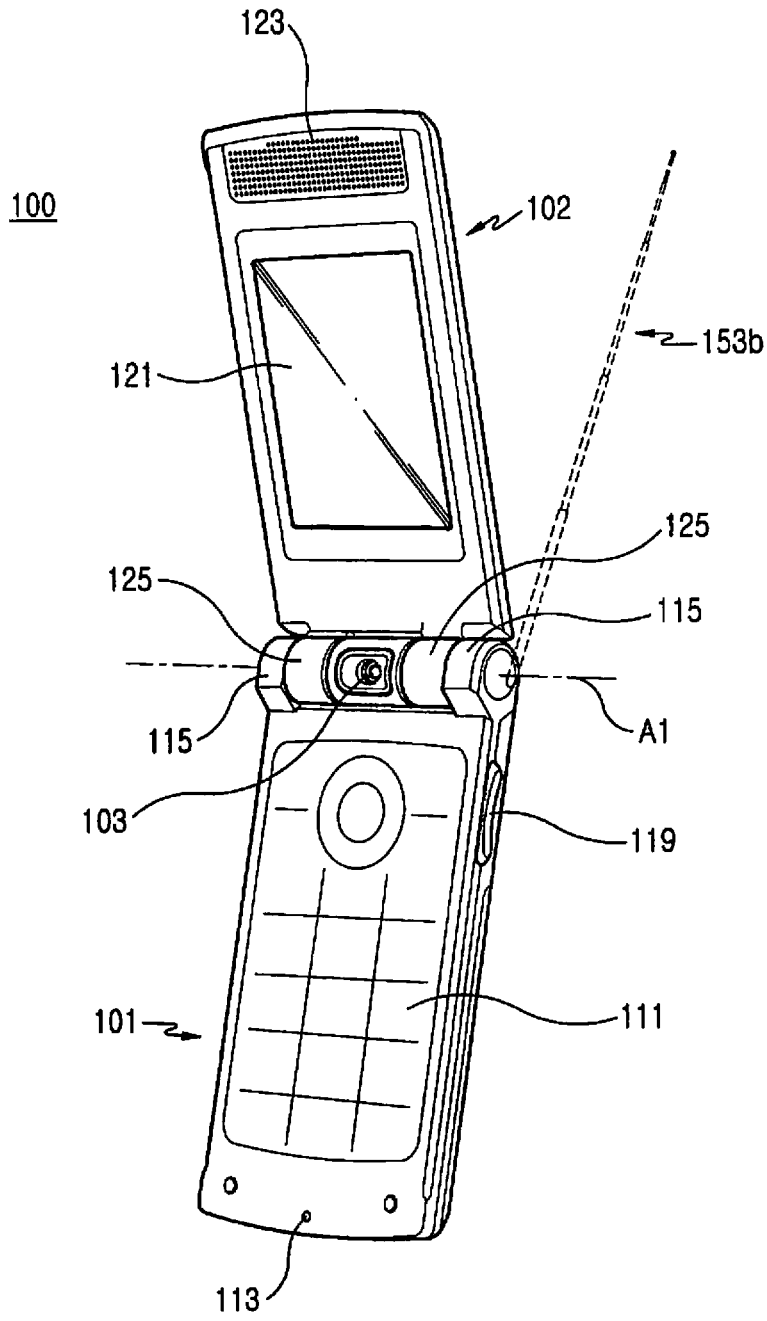
FIG. 1 is a perspective view of a portable terminal having an antenna device according to an embodiment of the present invention.
Figure 2:
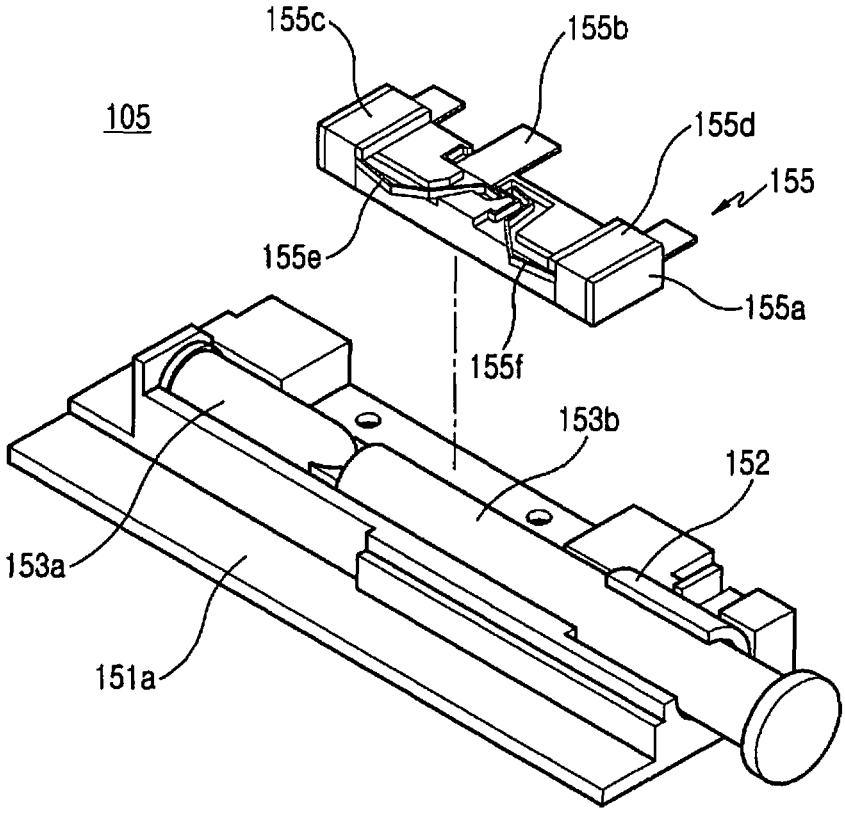
FIG. 2 is an exploded perspective view of the antenna device of the portable terminal illustrated in FIG. 1.

FIG. 1 is a perspective view of a portable terminal 100 having an antenna device 105 according to embodiment of the present invention. The antenna device 105 is shown in FIGS. 2 to 5 and will be further discussed below. Referring to FIG. 1, the portable terminal 100 includes a first housing 101 having a communication circuit portion therein and a second housing 102 engaged with the first housing 101 to be opened and closed by rotating with respect to a hinge axis A1.

The first housing 101 is provided, on one surface thereof, with input devices including a keypad 111 and a transmitter 113. A volume key 119 can further be provided on a side surface of the first housing 101. The second housing 102 is provided, on one surface thereof, with output devices including a display 121 and a receiver 123, and the keypad 111, the transmitter 113, the display 121, and the receiver 123 are opened or closed along with rotation of the second housing 102.

To rotatably engage the first housing 101 with the second housing 102, the first housing 101 has a pair of side hinge arms 115 therein and the second housing 102 has a pair of center hinge arms 125 formed apart from each other therein. The center hinge arms 125 are interposed between the side hinge arms 115 and rotatably engaged with the side hinge arms 115 by a hinge device (not shown). A camera lens 103 can be rotatably installed between the center hinge arms 125.

The antenna device 105 shown in FIGS. 2 to 5 is installed within the first housing 101. A second radiator with a rod antenna 153*b* extended from the antenna device 105 is illustrated in FIG. 1.

While the portable terminal 100 with the antenna device 105 is a folder type in this embodiment of the present invention, it is clear to those skilled in the art that the antenna device 105 is applicable to any type of terminal such as a bar type, a sliding type, a swing type, etc., as far as communicating wirelessly.

The structure of the antenna device 105 of FIGS. 2 to 5 will now be described.

Referring to FIGS. 2 to 5, the antenna device 105 includes a first radiator (not shown) installed within the terminal 100, the second radiator that can be retracted/extended into/from the terminal 100, and a switch portion having at least one plate spring. With the second radiator retracted into the terminal 100, the switch portion, specifically the plate spring, connects the first radiator to the communication circuit portion. When the second radiator is extended from the terminal 100, the plate spring connects the second radiator to the communication circuit portion. When the first radiator is connected to the communication circuit portion, the second radiator is disconnected from the first radiator and the communication circuit portion. When the second radiator is connected to the communication circuit portion, the first radiator is disconnected from the second radiator and the communication circuit portion. In accordance with this embodiment of the present invention, the switch portion includes a pair of plate springs in the antenna device 105.

The switch portion includes an antenna carrier 151*a*. The first radiator (not shown) is attached onto the bottom surface of the antenna carrier 151*a* and the second radiator can be contained in a mounting groove 151*b* formed on the top surface of the antenna carrier 151*a*. That is, the second radiator is positioned in the mounting groove 151*b* when the second radiator is retracted into the terminal 100. The antenna carrier 151*a* is formed by injection molding, for fabricating the antenna device 105 to a single module. That is, if a structure for installing the switch portion and the first and second radiators is formed within the terminal 100, specifically the first housing 101, there is no need for fabricating the antenna carrier 151*a* and the structure can be formed integrally on an inner surface of the first housing 101. A manufacturer can make a choice between the structure and the antenna carrier 151*a*, taking into account the structure, fabrication cost, and assembly of a product.

The first radiator is formed of a conductive metal plate in an antenna pattern. The first radiator is attached to bottom of the antenna carrier 151*a* or formed by using a circuit pattern printed on the outer circumference surface of the antenna carrier 151*a*. If the antenna carrier 151*a* is integrated into the first housing 101 or the first housing 101 has room for attaching the first radiator, the first radiator is attached directly to an appropriate position of the inner circumferential surface of the first housing 101. The first radiator is connected to the communication circuit portion through a first plate spring 155*e*.

The second radiator is elongated lengthwise and installed to retract/extend into/from the first housing 101. The first housing 101 may be provided with a bushing 152 for guiding the retraction/extension of the second radiator. The bushing 152 functions to guide sliding of the second radiator and connect the second radiator to the communication circuit portion, specifically a second plate spring 155*f*. That is, the second radiator is connected to the communication circuit portion through the bushing 152 and the second plate spring 155*f*.

The second radiator includes a sliding terminal 153*a* for sliding within the mounting groove 151*b* and a rod antenna 153*b* rotatably combined with the sliding terminal 153*a*. The rod antenna 153*b*, which includes at least one pair of tubes, can be fabricated as a multi-antenna with one of the tubes being retractable/extendable into/from the other tube. The rod antenna 153*b* of the second radiator illustrated in FIG. 1 is a multi-antenna with three tubes.

When the second radiator retracts into the mounting groove 151*b* in the terminal 100, the sliding terminal 153*a* and the rod antenna 153*b* are in a straight line. Since the outer circumferential surface of the second radiator, specifically the outer circumferential surface of the rod antenna 153*b* is coated with an insulation material, the second radiator is electrically isolated from the bushing 152.

Figure 3:
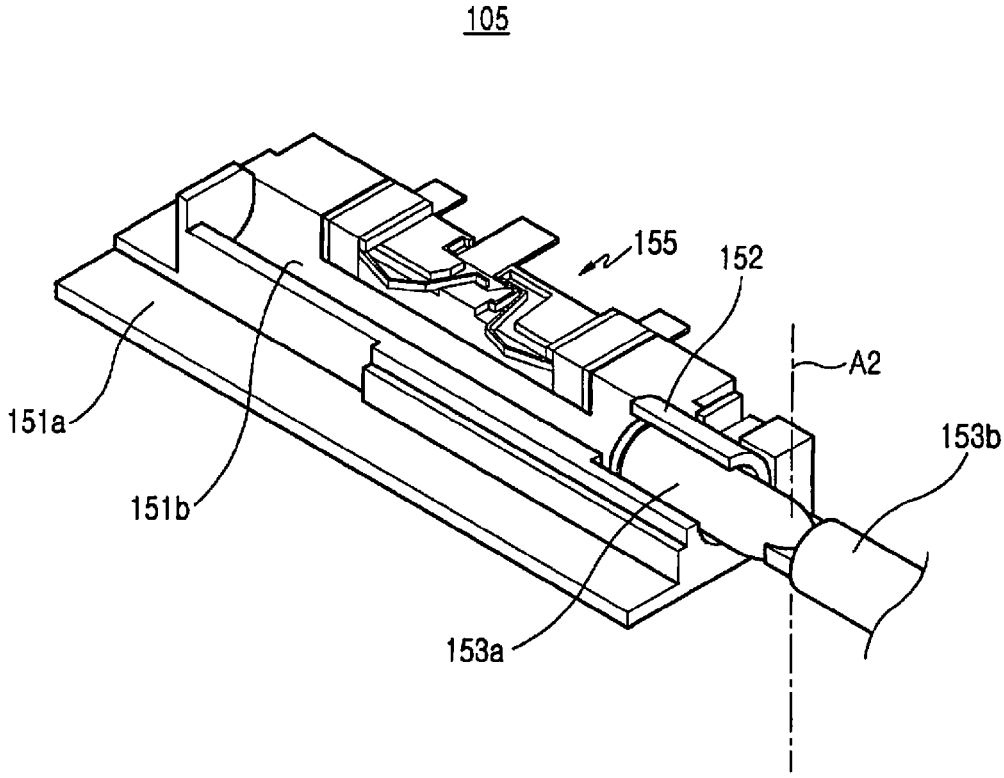
FIG. 3 is an assembled perspective view of the antenna device illustrated in FIG. 2.

When the second radiator is fully extended from the terminal 100, the sliding terminal 153*a* is engaged with the bushing 152 by forced insertion and thus, the second radiator, specifically the rod antenna 153*b*, is electrically connected to the bushing 152 through the sliding terminal 153*a*. With the second radiator fully extended from the terminal 100, the rod antenna 153*b* rotates along a rotation axis A2 defined on the engaged portion of the sliding terminal 153*a* and the rod antenna 153*b*, as shown in FIG. 3. Also, since the sliding terminal 153*a* is configured to rotate within the bushing 152 while the sliding terminal 153*a* is engaged with the bushing 152 by forced insertion, the rod antenna 153*b* can be controlled to point in various directions.

The switch portion includes a switch module 155 mounted to the antenna carrier 151*a* and the first and second plate springs 155*e* and 155*f* are installed in the switch module 155. While the antenna carrier 151*a* and the switching module 155 are configured separately to facilitate assembly of the first and second plate springs 155*e* and 155*f*, there is no need for separating the antenna carrier 151*a* and the switching module 155 if a structure for assembling the first and second plate springs 155*e* and 155*f* is formed in the antenna carrier 151*a*. That is, the first and second plate springs 55*e* and 155*f* can be fixedly installed on the antenna carrier 151*a*, thereby connecting the first and second radiators to the communication circuit portion.

The switch module 155 is provided with a switch base 155*a* and a first power supply terminal 155*c*, a second power supply terminal 155*d*, and a connector 155*b* that are installed on the switch base 155*a*. The first and second plate springs 155*e* and 155*f* are mounted in the switch base 155*a*, connected to the first and second power supply terminals 155*c* and 155*d*, respectively.

The first power supply terminal 155*c*, which surrounds a portion of the switch base 155*a*, has one end connected to the first radiator attached to the bottom surface of the antenna carrier 151*a*. The first plate spring 155*e* has one end fixed to another end of the first power supply terminal 155*c* and another end rendered movable on the switch base 55*a*. The first plate spring 155*e* is selectively interfered by the second radiator. In this case, the other end of the first plate spring 55*e* contacts the connector 155*b*. If the second radiator does not interfere with the first plate spring 155*e*, the other end of the first plate spring 155*e* is removed from and does not contact the connector 155*b*.

Figure 4:
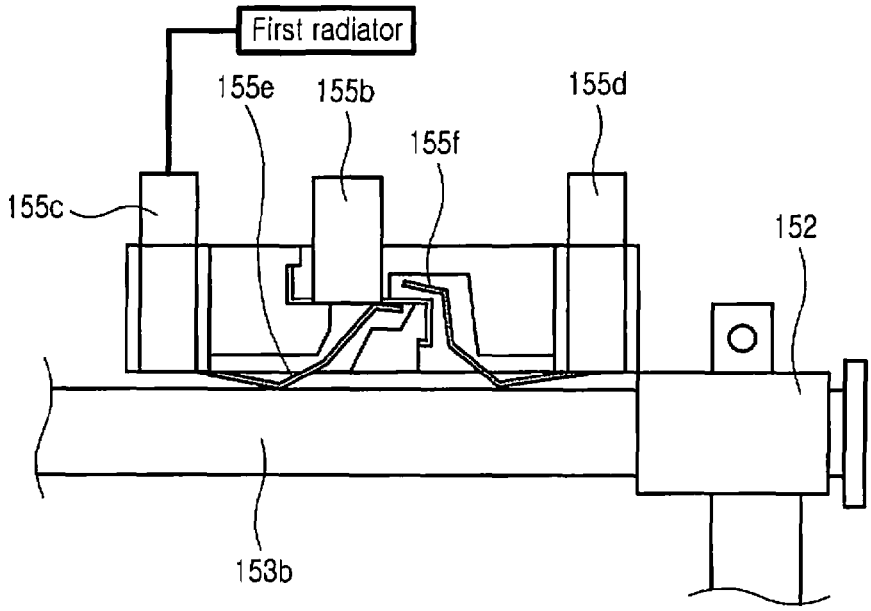
FIGS. 4 and 5 are plan views illustrating operations of the antenna device illustrated in FIG. 2.

The second power supply terminal 155*d* is installed at the other portion of the switch base 155*a* and is connected to the bushing 152 by a separately procured line, for example, a Flexible Printed Circuit (FPC). The second plate spring 155*f* has one end fixed to one end of the second power supply terminal 155*d* and another end rendered movable on the switch base 155*a*. The second plate spring 155*f* is also selectively interfered by the second radiator. When the second plate spring 155*f* is interfered by the second radiator, the second plate spring 155*f* is removed from and does not contact the connector 155*b*, as shown in FIG. 4. If the second plate spring 155*f* is not interfered by the second radiator, the elastic force of the second plate spring 155*f* brings the other end of the second radiator into contact with the connector 155*b*, as shown in FIG. 5.

The connector 155*b*, which is disposed between the first and second power supply terminals 155*c* and 155*d*, connects to the communication circuit portion through a separately procured FPC. That is, a signal applied from the communication circuit portion on the switch module 155 is transferred to the first or second radiator through the connector 155*b*, and a signal received from the first or second radiator is transferred to the communication circuit portion through the connector 155*b*.

Figure 5:
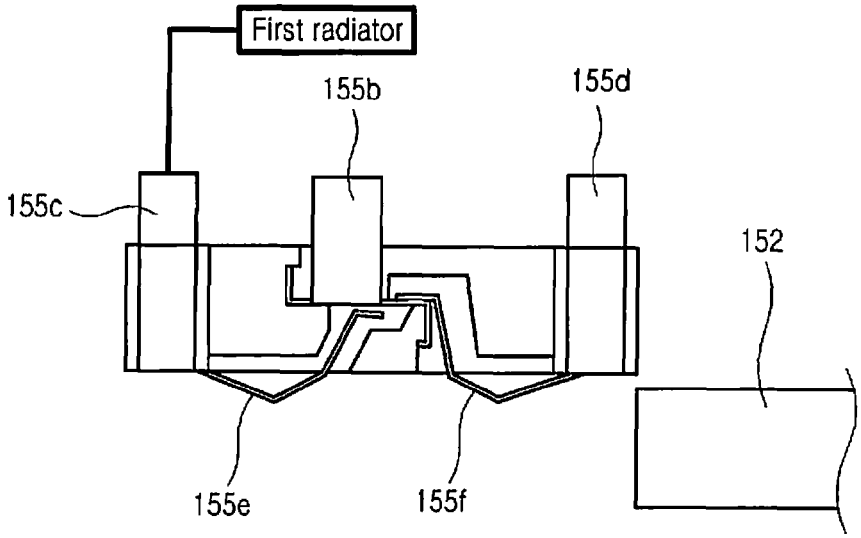

In the mean time, when the first and second plate springs 155*e* and 155*f* are initially installed in the switch module 155 and are not interfered by the second radiator, the first plate spring 155*e* is maintained removed from and does not contact the connector 155*b* and the second plate spring 155*f* is maintained in contact with the connector 155*b*, as in FIG. 5.

FIG. 4 illustrates the second radiator retracted into the terminal 100. When the second radiator is retracted into the terminal 100, the second radiator, specifically the rod antenna 153*b*, interferes with both the first and second plate springs 155*e* and 155*f*. Along with the interference of the second radiator, the other end of the first plate spring 155*e* is connected to the connector 155*b*, whereas the other end of the second plate spring 155*f* is removed from and does not contact the connector 155*b*. That is, when the second radiator stays within the terminal 100, only the first radiator is electrically connected to the communication circuit portion through the first power supply terminal 155*c*, the first plate spring 155*e*, and the connector 155*b*. Meanwhile, since the rod antenna 153*b* is coated with an insulation material on the outer circumferential surface of the rod antenna 153*b*, the second radiator is electrically isolated from the connector 155*b* despite interference with the first plate spring 155*e*.

Consequently, with the second radiator retracted into the terminal 100, only the first radiator operates and the second radiator is disconnected from the first radiator or the communication circuit portion.

FIG. 5 illustrates the second radiator extended from the terminal 100. When the second radiator is extended from the terminal 100, the first and second plate springs 155*e* and 155*f* tend to their initial state by their elastic force without interference from the second radiator. Therefore, the other end of the first plate spring 155*e* returns to an initial state with an elastic force, that is, to a position where the first plate spring 155*e* is removed from and does not contact the connector 155*b*, and the other end of the second plate spring 155*f* is brought into contact with the connector 155*b* by elastic force of the second plate spring 155*f*. That is, when the second radiator is extended from the terminal 100, the first and second plate springs 155*e* and 55*f* tend to return their other ends to the initial assembled position by their elastic force. Thus, only the second radiator is connected to the communication circuit portion through the bushing 152, the second plate spring 155*f*, and the connector 155*b*. With the second radiator extended, the first radiator is disconnected from the second radiator and the communication circuit portion. Therefore, the second radiator can operate stably without interference from the first radiator.

Figure 6:
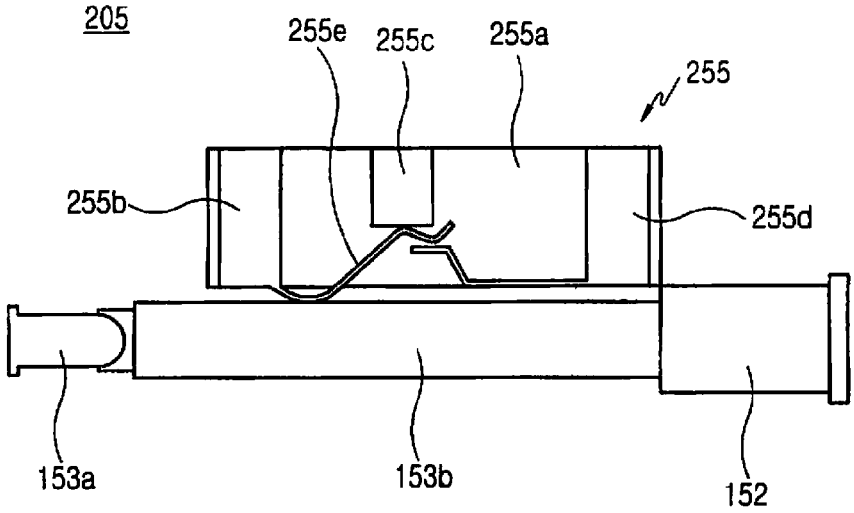
FIGS. 6 and 7 are plan views illustrating an operation of an antenna device according to another embodiment of the present invention.
Figure 7:
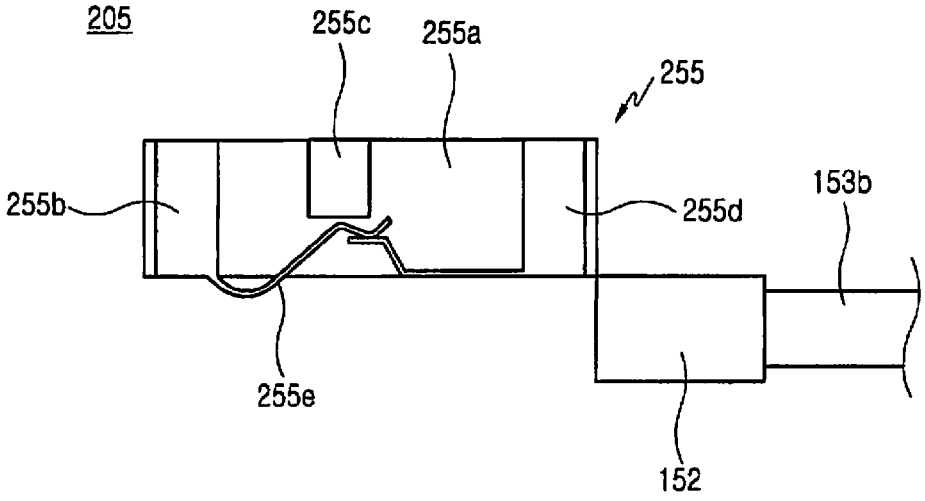

FIGS. 6 and 7 are plan views illustrating an operation of an antenna device 205 according to another embodiment of the present invention. The antenna device 205 uses one plate spring by modifying the switch module of the first embodiment of the present invention. Therefore, it is to be understood that the same components as in the first embodiment of the present invention or components easily understandable from the first embodiment of the present invention are not described herein and associated reference numerals are not illustrated.

Referring to FIGS. 6 and 7, a connector 255*b*, a first power supply terminal 255*c*, and a second power supply terminal 255*d* are arranged in this order from the left in a switch module 255 of the antenna device 205. One end of a plate spring 255*e* is fixed to the connector 255*b* and the other end thereof is rendered movable on the switch module 255.

The other end of the plate spring 255*e* is curved in the shape of 'S'. Part of the other end of the plate spring 255*e* selectively contacts the first power supply terminal 255*c* and another part thereof selectively contacts the second power supply terminal 255*d*. When only the connector 255*b*, the first and second power supply terminals 255*c* and 255*d*, and the plate spring 255*e* are initially assembled, the other end of the plate spring 255*e* is maintained in contact with the second power supply terminal 255*d* and does not contact the first power supply terminal 255*c*.

FIG. 6 illustrates the second radiator inserted into the terminal 100 according to the second embodiment of the present invention. When the second radiator is retracted into the terminal 100, the plate spring 255*e* is interfered with by the outer circumferential surface of the second radiator and the other end of the plate spring 255*e* contacts the first power supply terminal 255*c*. Therefore, the second radiator is disconnected from the communication circuit portion, and only the first radiator connects to the communication circuit portion.

FIG. 7 illustrates the second radiator extended from the terminal 100 according to the second embodiment of the present invention. When the second radiator is extended from the terminal 100, the plate spring 255*e* brings the other end of the plate spring 255*e* into contact with the second power supply terminal 255*d* by elastic force without interference from the second radiator. Therefore, when extended, the second radiator is connected to the communication circuit portion through the bushing 152, the plate spring 255*e*, and the connector 255*b*, whereas the first radiator is disconnected from the communication circuit portion.

As described above, since a radiator to connect to the communication circuit portion is selected appropriately by the plate springs 155*e* and 155*f* or the plate spring 255*e* according to the retraction/extension of the external antenna, i.e. the second radiator, the terminal 100 can perform a communication function stably even in a bad propagation environment.

As is apparent from the above description, the present invention selectively connects the internal antenna, i.e. the first radiator or the retractable/extendable external antenna (the second radiator), to the communication circuit portion by the plate spring(s) interfered by the second radiator according to the retraction/extension of the second radiator. As one radiator is disconnected from the communication circuit portion or the other radiator during operation of the other radiator, the other radiator can have a unique radiation performance.

Therefore, the antenna device of the present invention is conveniently carried because only the built-in first radiator operates without the need of using the extended antenna in a good propagation environment. Also, when retracted into the portable terminal, the second radiator is disconnected from the communication circuit portion or the first radiator, which makes the first radiator operate stably despite introduction of a noise signal to the second radiator.

Furthermore, when the second radiator is extended, the first radiator is disconnected from the communication circuit portion or the second radiator by the switch portion, only the second radiator is connected to the communication circuit portion. Therefore, the second radiator can operate stably.

While the invention has been shown and described with reference to certain preferred embodiments of the present invention thereof, it will be understood by those skilled in the art that various changes in form and details may be made therein without departing from the spirit and scope of the present invention as defined by the appended claims and their equivalents.

What is claimed is:

1. An antenna device for a portable terminal, comprising:

a first radiator installed within the portable terminal;

a second radiator including a rod antenna, the rod antenna elongated in a lengthwise direction and installed to be retractable into and extendable from the portable terminal; and a switch portion having at least one plate spring, for connecting a communication circuit portion of the portable terminal selectively to the first radiator or the second radiator, wherein the rod antenna is coated with an insulation material on the outer circumferential surface when the second radiator is retracted into the portable terminal, the second radiator interferes with the at least one plate spring on the outer circumferential surface of the rod antenna so that the communication circuit portion is connected to the first radiator through the at least one plate spring, and when the second radiator is extended from the portable terminal, the communication portion is connected to the second radiator through the at least one plate spring, wherein one end of the at least one plate spring has two bends in opposing directions as to create a shape of an "S" or a "Z".

2. The antenna device of claim 1, wherein the second radiator further comprises:

a sliding terminal for sliding in the portable terminal; and the rod antenna is extendable in a lengthwise direction and rotatably combined with the sliding terminal.

3. The antenna device of claim 1, wherein the second radiator is a multi-antenna having a pair of tubes extended lengthwise, one tube being retractable into and extendable from the other tube.

4. The antenna device of claim 1, wherein the switch portion comprises:

an antenna carrier having an outer circumferential surface attached with the first radiator and a groove for mounting the second radiator;

a first plate spring having one end connected to the first radiator and fixed to the antenna carrier and one other end rendered movable;

a second plate spring having one end connected to the second radiator and fixed to the antenna carrier and one other end rendered movable; and a connector connected to the communication circuit portion and installed in the antenna carrier, wherein when the second radiator is retracted into the portable terminal, the first and second plate springs are interfered with by the outer circumferential surface of the second radiator, the other end of the first plate spring contacts the connector, and the second plate spring is disconnected from the connector, and when the second radiator is extended from the portable terminal, the first plate spring is removed from the connector by an elastic force of the first plate spring and simultaneously, the other end of the second plate spring contacts the connector by an elastic force of the second plate spring.

5. The antenna device of claim 4, further comprising a bushing installed in the antenna carrier, wherein when the second radiator is extended from the portable terminal, the second radiator is electrically connected to the second plate spring through the bushing.

6. The antenna device of claim 5, wherein the second radiator further comprises;

a sliding terminal for sliding in the portable terminal, the rod antenna is extendable in a lengthwise direction and rotatably combined with the sliding terminal, and when the second radiator is extended from the portable terminal, the sliding terminal is combined with the bushing by forced insertion.

7. The antenna device of claim 4, wherein the switch portion further comprises first and second power supply terminals installed in the antenna carrier, wherein the first power supply terminal is electrically connected to the first radiator, and when the second radiator is extended from the portable terminal, the second power supply terminal is electrically connected to the second radiator.

8. The antenna device of claim 7, wherein the one end of the first plate spring is fixed to the first power supply terminal and the one end of the second plate spring is fixed to the second power supply terminal.

9. The antenna device of claim 1, wherein the switch portion comprises;

an antenna carrier having an outer circumferential surface attached with the first radiator and a groove for mounting the second radiator;

a connector connected to the communication circuit portion and installed in the antenna carrier;

a first power supply terminal installed in the antenna carrier and electrically connected to the first radiator;

a second power supply terminal installed in the antenna carrier, for electrically connecting to the second radiator, when the second radiator is extended from the portable terminal; and a plate spring having one end fixed to the connector, wherein when the second radiator is retracted into the portable terminal, the plate spring is interfered with by the outer circumferential surface of the second radiator and contacts the first power supply terminal, and when the second radiator is extended from the portable terminal, the plate spring contacts the second power supply terminal by an elastic force of the plate spring.

10. The antenna device of claim 9, further comprising a bushing installed in the antenna carrier, wherein when the second radiator is extended from the portable terminal, the second radiator is electrically connected to the plate spring through the bushing.

11. The antenna device of claim 10, wherein the second radiator comprises:

a sliding terminal for sliding in the portable terminal, the rod antenna is extendable in a lengthwise direction and rotatably combined with the sliding terminal, and when the second radiator is extended from the portable terminal, the sliding terminal is combined with the bushing by forced insertion.

12. The antenna device of claim 10, wherein the second radiator is retracted into and extended from the portable terminal by sliding through the bushing.

* * * * *